United States Patent [19]

Borgner

[11] Patent Number: 4,627,781

[45] Date of Patent: Dec. 9, 1986

[54] BAG CUTTING-AND EMPTYING-DEVICE WITH CONNECTED COLLECTIVE DUST-REMOVAL FILTER

[75] Inventor: Klaus Borgner, Hirzenhain, Fed. Rep. of Germany

[73] Assignee: Luco-Technic GmbH Verfahrenstechische Anlagen, Ortenberg, Fed. Rep. of Germany

[21] Appl. No.: 665,549

[22] Filed: Oct. 26, 1984

[30] Foreign Application Priority Data

Nov. 11, 1983 [DE] Fed. Rep. of Germany ..... 3340894

[51] Int. Cl.[4] ..... B65B 69/00

[52] U.S. Cl. ..... 414/412; 414/291; 83/660; 141/330; 30/272 R; 30/278; 222/83; 222/87

[58] Field of Search ..... 414/403, 411, 412, 415, 414/291; 222/81, 83, 87; 30/272 R, 278; 141/329, 330; 83/660

[56] References Cited

U.S. PATENT DOCUMENTS

| | | | |
|---|---|---|---|
| 3,224,609 | 12/1965 | Dietert | 414/412 |
| 3,606,057 | 9/1971 | June | 414/412 |
| 4,252,489 | 2/1981 | Mechalas | 414/412 |

FOREIGN PATENT DOCUMENTS

| | | | |
|---|---|---|---|
| 1267615 | 5/1968 | Fed. Rep. of Germany | 222/81 |
| 2218026 | 11/1973 | Fed. Rep. of Germany | 414/412 |
| 318718 | 1/1972 | U.S.S.R. | 414/412 |
| 484136 | 3/1976 | U.S.S.R. | 414/412 |
| 494314 | 3/1976 | U.S.S.R. | 414/412 |
| 662431 | 5/1979 | U.S.S.R. | 414/412 |

*Primary Examiner*—Frank E. Werner

*Attorney, Agent, or Firm*—Marmorek, Guttman & Rubenstein

[57] ABSTRACT

The invention relates to a bag-cutting- and emptying-device with a connected collective dust-removal filter, whereby it is the aim to replace the manual cutting process customary in devices of this type by a driven knife and to fix the position of the bag within the housing in such a manner so that this bag can be seized manually and can be shaken.

Hereby, also in the case of an additional manual intervention, the bag-feeding-area is to be protected against infiltrating excess air through the intervention of appropriate means surrounding the bag.

The invention makes provisions for the feeding of the bag through the intervention of a supporting-table (7/8) ending in a bag-chute (8), whereby the final boundary of the bag-chute (8) can be delimited by means of a stop-flap (15) for the support of the bag.

In this position, the bag is cut in a curved manner by means of a knife (20) arranged at rocking-levers (19), with this being done in such a way so that the cut ends directly in front of the bag edge lying on top of the bag-chute (8). By means of the pressure cylinder (16) and theknife (20), the stop-flap (15) is driven in the direction of the end-position at each given time whereby, after execution of the cut, the stop-flap (15) is pivoted in downward position.

10 Claims, 4 Drawing Figures

BAG CUTTING-AND EMPTYING-DEVICE WITH CONNECTED COLLECTIVE DUST-REMOVAL FILTER

The invention relates to a bag-cutting- and emptying-device with connected collective dust-removal filter or with a dust exhaust-hood and a discharge-housing leading into a central exhaust unit.

From the German Pat. No. 1,093,297 one knows of a device for the dust-free emptying of powdery goods from paper bags, with utilization of discharge-compartments, that is to say housings, one criterium of which is the superposition of a bag, which is slit open at its extremity facing the compartment, onto a drop table which, to begin with, is directed horizontally and is a component of a transport cart, and the other criterium of which is the manual cutting guidance. During the entering into the compartment or into the housing, the drop table is released whereby, at closed housing door, the bag which moreover is retained by means of pins, is swung with its opened side in emptying direction.

After the emptying process has taken place, the door is opened again whereby, during the retraction of the transport cart, the drop table is again swung back into its normal position and the empty bag lying on top of it, can be removed. An exhaust-air filter is connected to the housing.

Despite its simplicity and despite the relative freedom from dust, this system has aggravating disadvantages namely in that, on the one hand, in particular in the case of goods which are not very free-flowing or form bridges, the complete emptying of the bag is questionable due to the absence of a manual intervention possibility and, on the other hand, the danger of injury to the operating personnel is relatively high, due to the top-end cut which has to be carried out manually.

Furthermore, through the German Pat. No. 911,478, a device is known for the dust-free emptying of paper bags into mixers, stirring devices, mills, etc., namely a device consisting of a container surrounding the filled bag standing in upright position, in the case of which the bottom of the container is provided with cutting tools, by means of which the bag is slit open in its bottom portion and the bagcontent, through the intervention of the outlet pipe, is emptied over a receiving vessel arranged below the same.

Since it is possible to close-off the entire system, the device can be designated as being conditionally dust-free.

Of disadvantage is the altogether not quite simple loading of the bag-receiving-container and the dust formation which is not completely avoidable since, in last analysis, the container cover has to be opened during the insertion of the bag and the bag, during the insertion, is cut at least in part prior to the closing of the cover.

Taking this prior art into consideration, and starting from the first cited document, that is to say the German Pat. No. 1,093,297, the task results of naming a device of this type, which eliminates a manual cutting of a discharge opening into the top-base of the bag prior to the introduction into the housing and the placement of the bag into an inclined discharge position and in which device, for the acceleration of the complete emptying, the bag can be manually manipulated, for example it can be moved while shaking it, through intervention in the bag feeding area, with this taking place at extensive control and closing of the area which had been exhausted by means of the central exhaust unit or the collective dust-removal filter.

The solution, in accordance with the invention, of this problem makes provisions that the supporting table is arranged between two supports which—at least in the area of its horizontal position—are designed in a cheek-like and double-walled manner, and the supporting table, hereby running into the discharge housing, leads to a bag chute which, on the outside, is closed-off by an apron, that the end of the bag chute can be limited for the support of the bag by means of a stopping flap which can be actuated in perpendicular direction to the bag chute by means of a cylinder acted upon by a pressure medium , and that in the supporting position of the stopping flap—directed toward the terminal portion of the bag chute—a knife, which is arranged at the inwardly directed walls of the two lateral supports and can be set into motion by means of a second pressure cylinder, is guided at rocking levers in such a manner, so that a curved cut, which ends directly in front of the bag edge lying on top of the bag chute, can be carried out with it.

The provided arrangement of the suporting table between the supports limiting the same on both sides, and the termination of the bag feeding area by means of a free-falling apron partially surrounding the bag, decrease the free cross-section so that, due to the automatically occurring increased air velocity, the suction capacity is also completely sufficient for the feeding area.

The end of the supporting table which leads into a bag chute, is limited by means of a stopping flap which can be actuated in a pivotable manner, whereby in the feeding position, the stop-flap serves a supporting surface for the bag.

Through a cylinder which is acted upon by a pressure medium, the stopping flap can be pivoted into the stop-position or into the discharge position.

In the stop-position, that is to say in the support-position, the knife which is driven by a second pressure cylinder and is arranged at rocking levers, is guided in a curved manner through the bag, stopping in front of the superimposed bag edge.

For the loosening of the goods it is expedient to first of all shake the stop-flap and then let it swing downwardly through a corresponding valve actuation whereby, in connection with the downward swinging motion, the bag has to be seized on both sides and has to be shaken.

In the course of the emptying of bags which are made of material which is particularly difficult to cut, it can be occasionally expedient that the knife, which is pivotably attached at rocking levers, can be guided back and forth to a small extent in the direction of the axis of the pivotal point through the intervention of a separate driving medium or through a curve-course guidance which is constructed in a displaceable manner.

In order to achieve a relative smooth operation of the bag-cutting-and emptying-device, it is proposed that the pressure cylinder for the driving of the stop-flap and the pressure cylinder for the driving of the knife are operable by pneumatic means.

For installations of this type, and in view of the possibility of the foreign-body-introduction into the bag, hydraulic transfer media are not suited.

In order to avoid mix-ups during the actuation of the two drives, provisions are made that the drive for the stop-flap is controllable by means of a foot - valve and the drive for the knife is controllable by means of a hand - valve.

The precedingly given direction of destroying bridge formations or the like through repeated actuation of the valve controlling the stop-flap, can still be further expanded, in that the stop-flap can be designed as a shaking-unit which can be actuated in the area of the support-position.

Since the manual shaking of the bag in itself contributes to the danger that an empty bag slips into the housing, provisions are made that an inspection door, which partially extends above the height and the width of the discharge housing, is arranged in one of the two lateral supports, whereby it can be additionally provided that, in outlet direction, the discharge-housing is bordered by a screen.

Independent thereupon, it is expedient when a pivotable flap which can be actuated through a hand-lever-system, is provided in the bag-chute for the removal of the empty bags and when the opened pivotable flap leads across to a duct, which is closed in outward direction and leads to the feeding-area of an empty-bag compacting-device, known in itself.

Finally, for the improvement of the exhausting operation it is proposed that, approximately at the height of the horizontal area of the bearing table, the supports are provided on both sides with one exhaust slit each extending over the intrinsic width of the horizontal table area.

Such a form of execution takes into consideration all requirements of the task set for the invention.

The bag-cutting- and emptying-device designed according to the invention, will be explained in more detail while making reference to the attached drawings.

Figure 1:
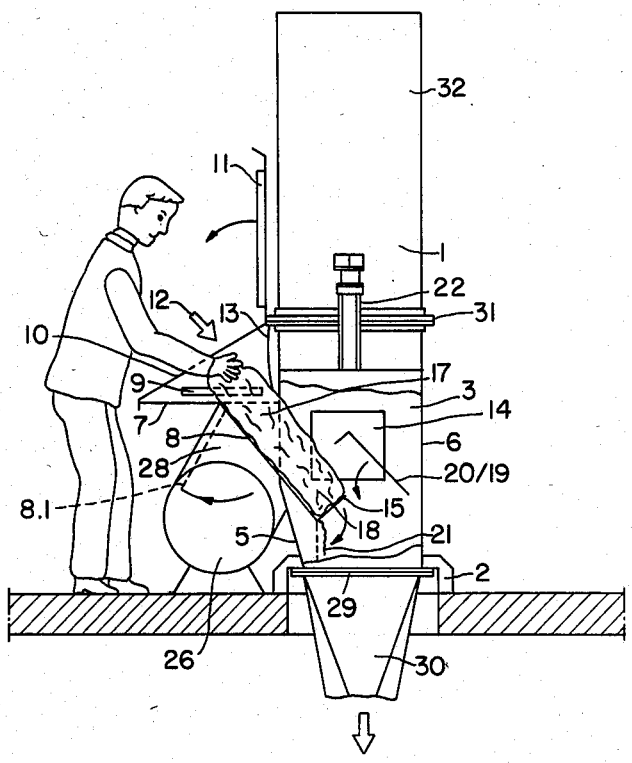
FIG. 1 shows the device in side view with assigned empty-bag compacting-device.
Figure 2:
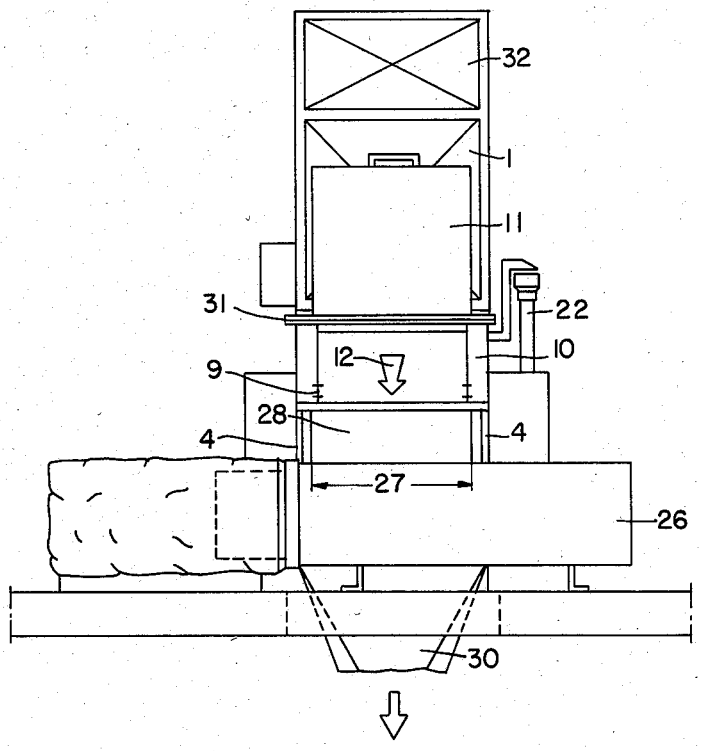
FIG. 2 shows the device in frontal view likewise with assigned empty-bag compacting device.

The bag-cutting- and emptying-device 1—hereafter briefly called "device 1"—is provided at its lower boundary with a flange-joint 29 for the connection with a transfer-funnel 30, and at its upper boundary is provided with a flange-joint 31 for the connection with the suction filter 32.

Furthermore, in the case of this example, a connecting-duct 28 is provided between the bag-chute 8 of the bag-travelling-table 7/8 and the feeding area 27 of an empty-bag-compacting device 26 which is arranged horizontally on the servicing-side whereby, for the delivery of the empty bags, the bag-chute 8 is provided with a pivotable flap 8.1 which can be actuated by means of a hand-lever system.

Going on to the design of device 1, it is to be remembered that this design consists of two bilateral supports 4, which are constructed in a double-walled manner at least in the area of the horizontal part 7 of the supporting-table 7/8 and moreover consists of a housing 3, which is formed by a frontward and rearward wall 5/6 and, for the passage of the goods, is supported by means of claw-like elements 2 in the area of the bottom-opening.

The horizontal part 7 of the supporting table 7/8 leads on both sides into one slit 9 each which engages with the double-cheeks of the supports 4, which slit 9 opens in each case into the housing. The supporting area is therewith accessible to an aspiration through the suction filter 32.

The horizontal part 7 of the supporting-table 7/8 is adjoined by the bag-chute 8 which, on its part, is provided with the precedingly mentioned manually operatable pivoting flap 8.1 for the removal of the empty bags.

Over the width of the horizontal table-part 7, the lateral cheek-like elements of the supports 4 extend upwardly in a desk-like manner and, on both sides, form a support 10 for the bag-feeding area 12 which is to be closed-off by means of a pivotable door 11 during the cleaning of the device 1. During the normal operation, the pivotable door 11 is held in an open, perpendicular position.

In order to restrict the excess air supply given in the bag-feeding area 12 around the upper and lateral periphery of the bag cross-section, and in order to simultaneously increase the velocity of the suction-flow, a flexible apron 13 is provided along the bag-upper-edge of the bag-feeding area 12 which surrounds the bag cross-section at least in part.

Figure 3:
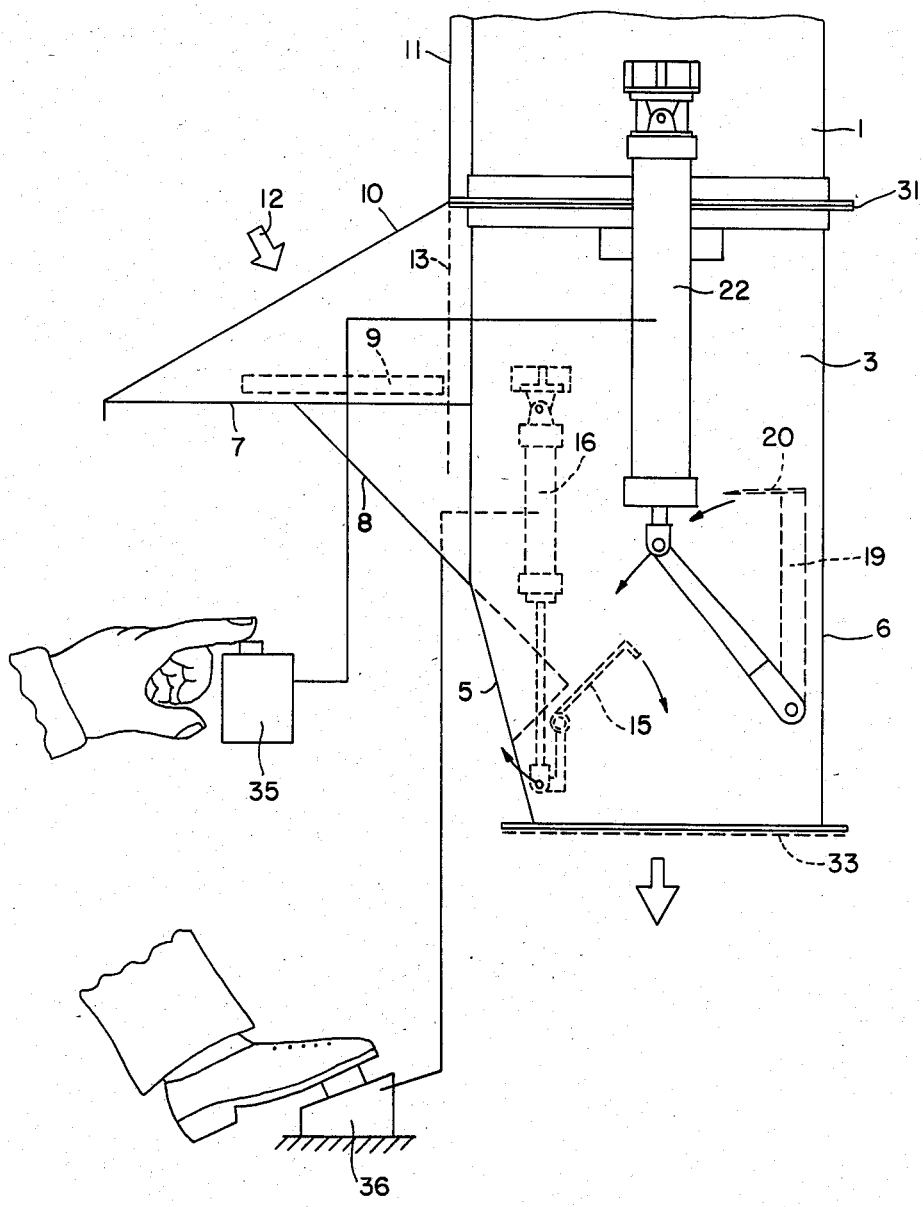
FIG. 3 shows a section of FIG. 1, at removed covering of the driving components.

One of the two supports 4 is provided with an inspection-door 14, in particular for the removal of unintentionally introduced empty bags, whereby, in discharge direction, the housing 3 is protected against infiltration of bag-material in conveying direction through the intervention of a screen 33 (FIG. 3).

In the area of the terminal boundary of the bag-chute 8, a stop-flap 15 is arranged in the housing 3, whereby this stop-flap 15 can be driven by means of a pneumatic cylinder 16 which is controlled by means of a foot-valve 36.

In the loading position of the device 1, the stop-flap 15 is in perpendicular direction to the bag-chute 8 and forms the supporting-surface for the delivered bag 17 which subsequently is to be cut. The stop-flap 15 and/or also the bag-chute 8 can be designed as a shaking unit.

In the bag discharge-position—present after the cutting process, which is described later on—the stop-flap 15, for the purpose of tilting the bag-chute 8, is brought into a downwardly deflecting angular setting which does not prevent the discharge process whereby, prior to this setting, through repeated brief manipulations of the foot-valve for the pneumatic cylinder 16, eventual bridge formations or other compactions within the area of the cut bag-discharge-openings 18, can be broken up through the stop-flap 15 which had been brought into the supporting position. The knife 20, additionally arranged in housing 3 coaxially in supports 4 and mounted on a pivotable lever 19, can be driven by means of a pneumatic-pressure cylinder 22 which, in a pivotable manner, is arranged at the outer side of a support 4, whereby the knife 20 is curved in a slightly v-shaped manner and is adjusted in such a manner so that a curved cut through the end region of the bag 17 can be executed in such a way, so that the superimposed edge-line of the bag bottom is not separated but, as opened flap 21, remains connected with the bottom of the bag 17 in a suspended manner.

In regard to the operation of the installation it is to be stated that the bag 17 to be emptied is manually deposited on the supporting table 7 and is pushed into the housing 3 via the bag-chute 8. The bag 17 which, through the intervention of the inclined plane, projects into the housing 3, comes to lie thereby against the stop-flap 15 with its downwardly directed frontal side. The apron 13 which covers the inlet opening, comes to lie thereby on the bag surface, so that the opening remains delimited in each case. Through the intervention of the hand-valve 35 which is arranged next to the supporting-table 7/8, the knife 20 is actuated whereby, after the valve-controlled release of the stop-flap 15 into the downward folding-position, the essential content of the bag 17 runs out.

The discharge process is intensified or influenced when the operator holds on to the bag 17 at the end projecting beyond the housing 3 and executes more or less vigorous shaking motions.

The deposit of the empty bag takes place within the area aspirated by means of the suction filter 32, whereby the empty bag can be removed, as it had been described.

For reasons of obtaining a clearer general view, the cylinders 16 and 22 were arranged in a bilaterally distributed manner in the example shown in the drawing. Of course, both cylinders can be arranged limited to one side alone.

Figure 4:
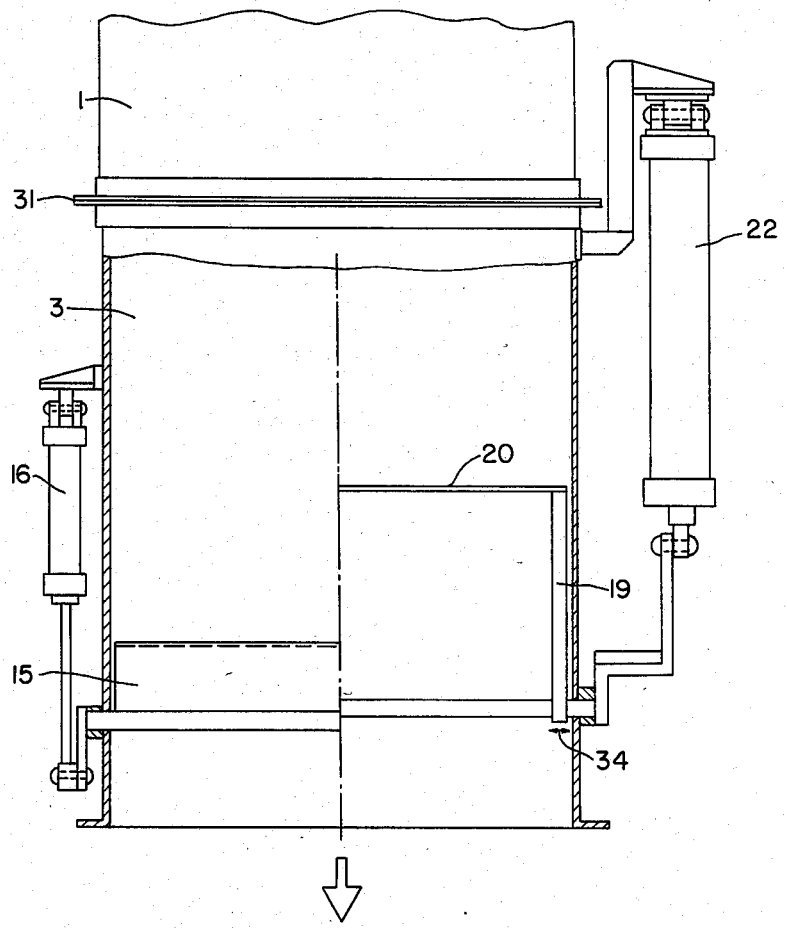
FIG. 4 shows a partially opened representation of a section of FIG. 2.

As mentioned above, the knife 20 can be arranged in a displaceable manner along its pivot axis. This is illustrated by the double-headed arrow 34 in FIG. 4.

I claim:

1. A bag cutting and emptying device, comprising:

a substantially closed housing, said housing including front, rear, and sidewalls, said housing having an opening therein for receiving a bag to be cut and emptied, said sidewalls being double-walled and having lateral projections, a flexible apron substantially covering said opening, dust removal means extending into said housing, a horizontal support table adjoining said housing, said support table being located between said lateral projections, a bag chute connected to said support table, said bag chute extending downwardly into said housing, an actuable stop flap located adjacent the lowermost portion of said bag chute, said stop flap being pivotable between a support position and an emptying position, first fluid pressure means associated with said stop flap for actuating said stop flap, an actuable knife for opening said bag, said knife being located inside said housing, said knife being pivotable about an axis when actuated.

second fluid pressure means associated with said knife for actuating said knife, and lever means connecting said knife to said second fluid pressure means, said lever means causing said knife to travel in an arc and to cut said bag in a curved manner in an area adjacent an edge of said bag supported by said stop flap upon actuation of said knife.

2. The bag cutting and emptying device of claim 1 wherein said knife is displaceable along said pivot axis.

3. The bag cutting and emptying device of claim 1 wherein said first and second fluid pressure means are pneumatic pressure means.

4. The bag cutting and emptying device of claim 3 further comprising a foot valve for operating said first fluid pressure means and a hand valve for operating said second fluid pressure means.

5. The bag cutting and emptying device of claim 1 wherein said stop flap shakes said bag on said bag chute.

6. The bag cutting and emptying device of claim 1 further comprising viewing means mounted in one of said sidewalls of said housing.

7. The bag cutting and emptying device of claim 6 further comprising a screen within said housing.

8. The bag cutting and emptying device of claim 1 further comprising a pivotable flap disposed in said bag chute for removing said bag after it has been emptied.

9. The bag cutting and emptying device of claim 8 further comprising bag compacting means connected to said pivotable flap for compacting said empty bags.

10. The bag cutting and emptying device of claim 9 wherein each of said lateral projections includes a slit therein.

* * * * *